US005328289A

United States Patent [19]

Fussler

[11] Patent Number: 5,328,289

[45] Date of Patent: Jul. 12, 1994

[54] SYSTEM FOR POSITIONING AND RETAINING AN ARTICLE OF MODULAR FURNITURE

[75] Inventor: Philippe Fussler, Strasbourg, France

[73] Assignee: Steelcase Strafor (S.A.), Strasbourg, France

[21] Appl. No.: 979,336

[22] Filed: Nov. 20, 1992

[30] Foreign Application Priority Data

Nov. 21, 1991 [EP] European Pat. Off. ..... 91440097.3

[51] Int. Cl.[5] ..... A47B 13/00

[52] U.S. Cl. ..... 403/332; 403/407.1; 403/348; 403/386

[58] Field of Search ..... 403/332, 406.1, 407.1, 403/348, 386

[56] References Cited

U.S. PATENT DOCUMENTS

| | | | |
|---|---|---|---|
| 3,575,465 | 4/1971 | Dolby et al. . | |
| 3,835,354 | 9/1974 | Torres-Pena | 403/406.1 X |
| 3,881,428 | 5/1975 | Klecki . | |
| 4,169,639 | 10/1979 | Zola . | |
| 4,300,455 | 11/1981 | Ornati . | |
| 4,505,611 | 3/1985 | Nagashima et al. | 403/406.1 |
| 4,755,000 | 7/1988 | Chiaro et al. . | |
| 4,966,421 | 10/1990 | Mengel . | |
| 5,112,110 | 5/1992 | Perkins . | |

FOREIGN PATENT DOCUMENTS

| | | | |
|---|---|---|---|
| 0504533A1 | 9/1992 | European Pat. Off. . | |
| 2546749 | 4/1977 | Fed. Rep. of Germany | 403/407.1 |
| 2734312 | 2/1978 | Fed. Rep. of Germany | 403/348 |
| 1412288 | 11/1975 | United Kingdom | 403/406.1 |

*Primary Examiner*—Randolph A. Reese
*Assistant Examiner*—Christopher J. Novosad
*Attorney, Agent, or Firm*—Mason, Fenwick & Lawrence

[57] ABSTRACT

A system for positioning and retaining in place an article of modular furniture in the form of a slab upon the upper face of a rest block comprises an intermediate piece and a fastener. The intermediate piece has a horizontal plate an arcuate heel extending upwardly from the upper face perpendicular to the plate at one end thereof, the shape and dimensions of the heel being the same as a concave recess provided in the external edge of the slab. The lower face of the plate includes a locking mechanism for locking the plate into a recess in the upper face of the rest block. The heel has a hole therethrough positioned to align with a hole in the concave recess in the external edge of the slab. The fastener includes a locking stud and a head, the head having a vertical planar part and a horizontal part which fully close the concave recess in the external edge of the slab when the stud is forced into the holes.

4 Claims, 2 Drawing Sheets

SYSTEM FOR POSITIONING AND RETAINING AN ARTICLE OF MODULAR FURNITURE

This invention relates to a new and improved system for positioning and maintaining a horizontal plate or board upon a horizontal surface such as the upper face of a rest element, typically when said plate and said rest element are pieces of a modular office furniture system, the main advantage of this positioning and maintaining system of the invention being that its pieces do not affect the horizontal faces of said plate, so that this plate can be used upside down without showing any part of the maintaining system.

A modular office furniture of this kind to which this invention can apply is described in European patent application EP-A-91440021.3 of the Applicant. In this prior system there is provided a plate resting upon a block equiped with drawers, shelves and the same, said plate being so designed as it can rest upon the block whatever one or the other horizontal face is turned upside. However, to position and maintain said plate upon said rest block, there are only provided studs/cups couples respectively on each horizontal face of the plate and/or on the upper face of the rest block or bolts passing through holes in the plate and engaging housings in the block.

This system has indeed the advantage to offer the possibility for a plate with an arcuate design to be turned upside down to invert the shape of said design, with a view to obtain working surfaces of various sinuous aspects; however, inasmuch the positioning means must be present on both faces, they are constantly visible, which affects the aesthethics of the assembly, the non-used means remaining visible on the upper horizontal face of the plate.

This invention eliminates this drawback with a new system for efficiently position and maintain an horizontal working plate upon an horizontal support, the pieces of this system acting only laterally, i.e. peripherally, upon the edges at said plate without affecting the horizontal faces thereof whatever its orientation.

To this end, according to this invention the upper face of the rest block is provided with a generally oblong recess forming locking means of the bayonet type for an horizontal pivoting intermediate plate having an upright cambered edge or heel, the working plate resting upon said intermediate piece and having in its edge a recess for receiving said cambered heel, said heel and said recess each having horizontal bores to receive a horizontal stud, said stud having a head, the shape of said head being such that its external vertical face is on a level with the working plate edge, so that said working plate edge recess is substantially closed by said head.

When in place within the resting block recess, the horizontal pivoting intermediate piece provides therefore:

a. through its vertical heel, the positioning of the working plate, and b. through said stud and its head, the immovable attachment of all the assembly pieces together.

A more detailed description of the invention is now given with reference to the attached drawings in which.

In all figures the same reference numerals are used for the same parts.

Figure 1:
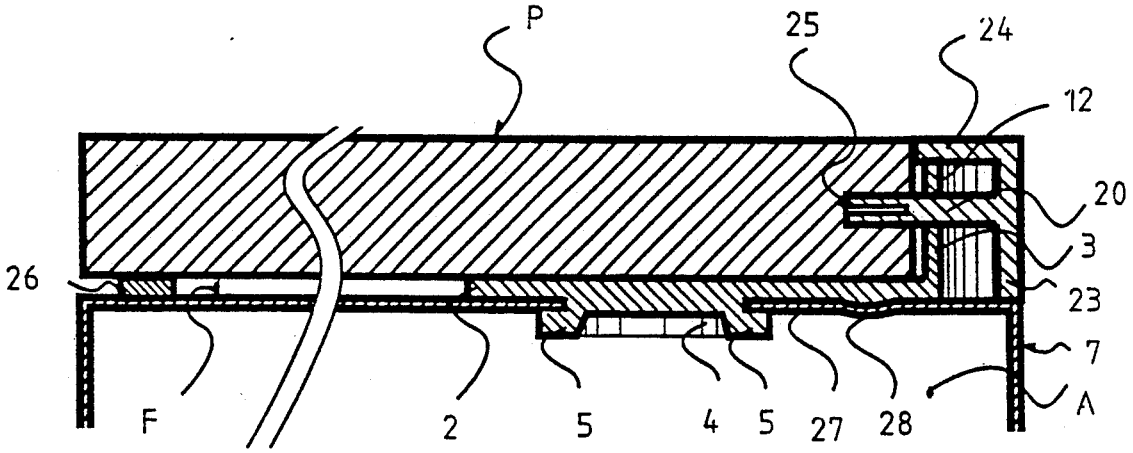
FIG. 1 is a vertical section of the assembly comprising the resting block, the working plate and the pieces forming the system of the invention, locked in place.

The invention has for object to position and maintain in place an horizontal plate or slab P upon the upper horizontal face F of a resting block A, without any piece of the system being visible at the plate P horizontal upper face.

To this effect, the system of the invention comprises an intermediate piece (1) having a horizontal plate (2) and an heel (3), of arcuate shape extending perpendicular to the horizontal plate (2).

The horizontal plate (2) is formed integrally with a substantially circular protruding plate or disk (4) having wings (5) at a distance under the plate (3) of about the thickness of the upper face F of the block A.

Figure 3:
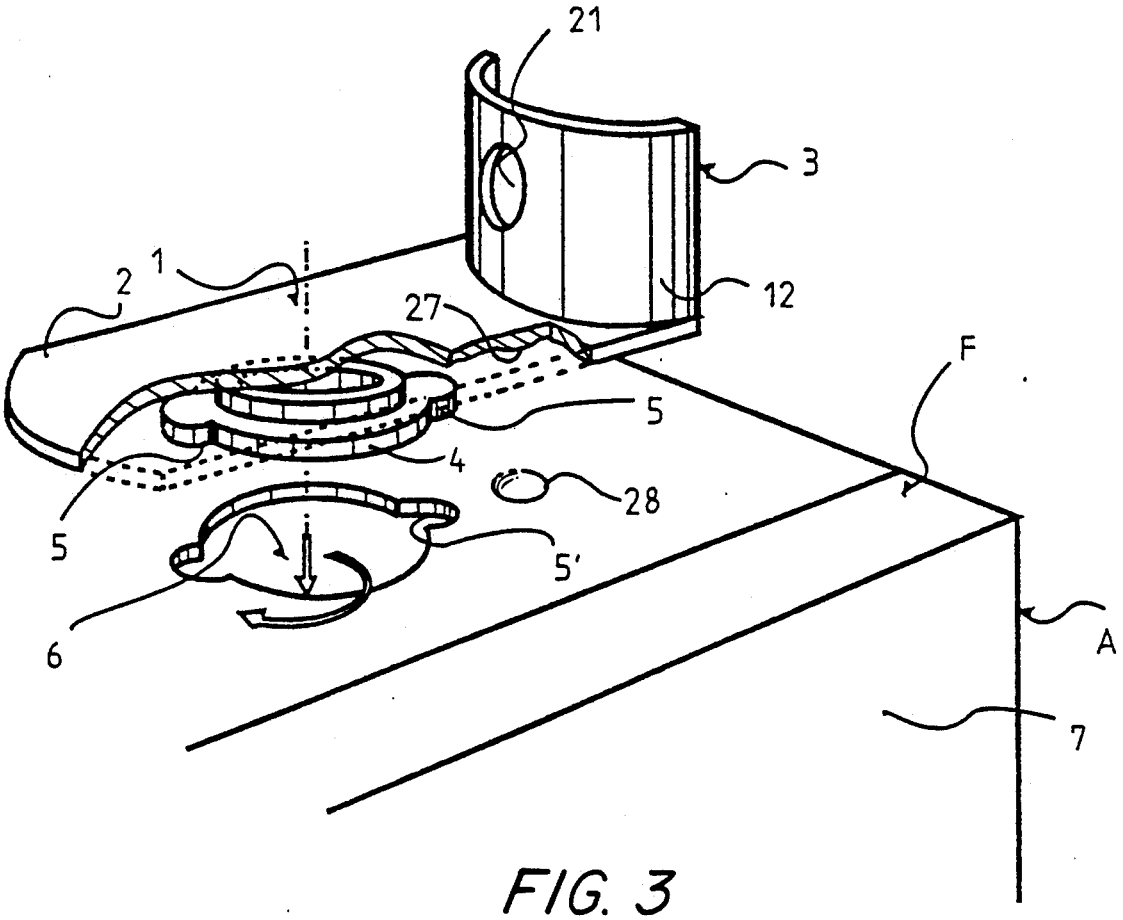
FIG. 3 shows in perspective the intermediate plate before being in place in the resting block upper face.
Figure 4:
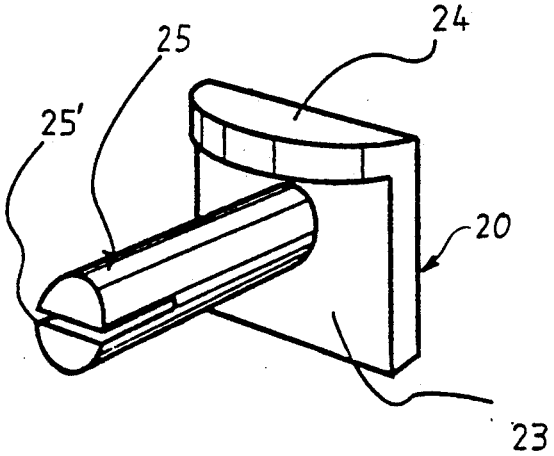
FIG. 4 shows in perspective the stud.

Said upper face F is formed with a recess or hole (6) having substantially the shape and the dimensions of the protruding plate (4), i.e. comprising wings (5'). As shows on FIG. 3, the wings (5) of the plate (4) and the wings (5') of the hole (6) are angularly shifted by 90° so that to put in place the piece (1), it needs only to have the wings (5) and (5') in mating position, then to rotate the piece (1), in the bayonet manner, by 90°, to have the piece (1) oriented in such a manner that its heel (3) is just above the edge (7) of the block A.

Figure 2:
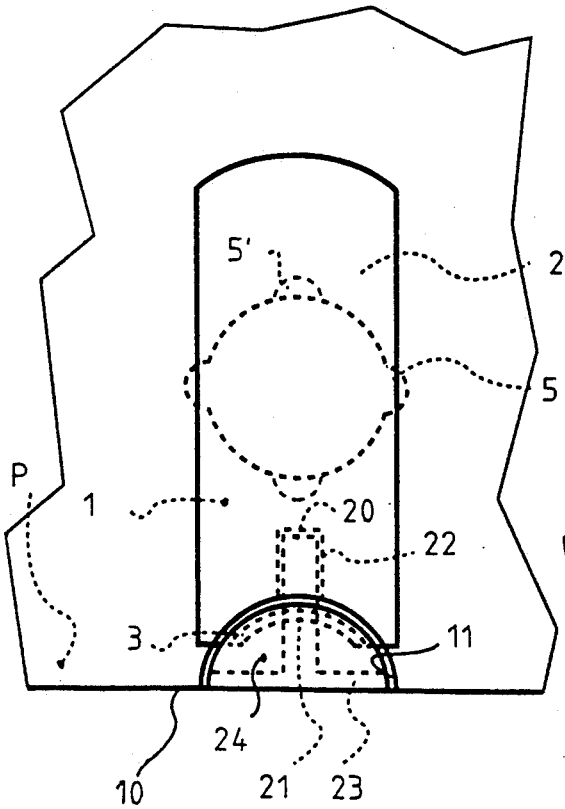
FIG. 2 is a top view of the same assembly including the stud.
Figure 2A:
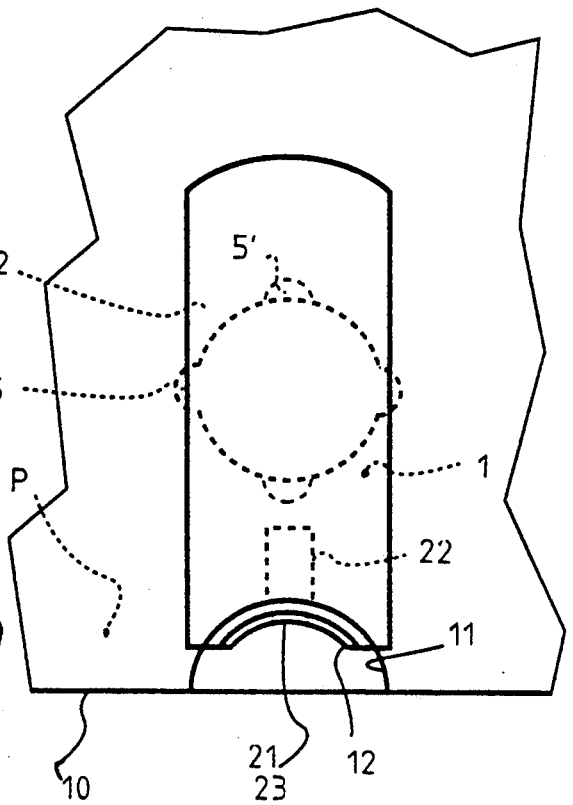
FIG. 2A is similar to FIG. 2, the stud being removed.

After the intermediate piece (1) is in place with the proper orientation and locked in the hole (6), the working plate P is simply laid there upon. To position said plate P, its edge (10) is provided with a recess (11) having the cylindrical shape and dimensions of the cambered part (12) of the heel (3) of the intermediate piece (1) as it appears on FIG. 2A.

After being placed in position, the plate P is locked in place with a fastener (20) including a stud (25) passing through a hole (21) of the heel (12) and engaging a hole (22) in the center of the recess (11).

Said fastener (20) has a head in the form of a brace comprising a vertical plane part (23) and a horizontal part (24) having the shape of a segment of a circle.

Said vertical part (23) when the stud (20) is in place is on a level with the edge (10) of the plate P, and said horizontal part (24) has the shape of the horizontal section of the recess (11), so that the head of the stud completely closes said recess (11), so that no part of the system of this invention are visible when the assembly is locked together by inserting the stud (25) in the holes (21) and (22).

The objects of the invention are therefore reached in a simple and efficient way.

According to some additional features, the tip of the stud (25) can be slit as shown (25') so that, by spreading the same, the assembly is improved.

To take into account the thickness of piece (1), between the horizontal faces of the plate P and of the block A, shims (26) can be inserted therebetween, at proper places.

To still improve the assembly aesthethics, the external faces of the head parts (23) and (24) can have the same surface treatment and/or color as the remaining edge (10) of the plate P.

To improve also the precision of the positioning of piece (1) upon the face F of the block A, optional additional means can be provided, such as a coupling protrusion (27) and cup (28) which are complementary in shape on FIG. 1.

All the parts of the system are movable, which allows easy maintaining and disassembling of the plate P upon different places of the block A, or upon different blocks A, with a view to produce different assemblies.

I claim:

1. A system for positioning and retaining in place an article of modular furniture upon the upper face of a rest block, the article of modular furniture being in the form of a slab having an external edge provided with a concave recess therein and a hole extending inwardly at the center of the concave recess, and the upper face of the rest block being provided with a recess therein, said system comprising:

an intermediate piece having a horizontal plate with upper and lower faces and opposed ends and an arcuate heel extending upwardly from said upper face perpendicular to said plate at one end thereof, said lower face of said plate including locking means for locking said plate into the recess in the upper face of the rest block, and said heel having the shape and dimensions of the recess provided in the external edge of the slab and having a hole therethrough positioned to align with the hole in the concave recess in the external edge of the slab;

a fastener including a locking stud and a head, said head having a vertical planar part and a horizontal part having the shape of a segment of a circle, said vertical planar part having the same height and width as the concave recess in the external edge of the slab, and said segment-shaped part being complementary in shape to the concave recess in the external edge of the slab, and said stud extending perpendicularly from said vertical planar part and being configured to pass through said hole in said heel of said intermediate piece and the hole in the concave recess in the external edge of the slab, whereby said fastener fully closes the concave recess in the external edge of the slab when said stud is forced into said holes.

2. The system of claim 1, wherein said locking means comprises a disk protruding from said lower face of said plate, said disk having opposed wings extending outwardly therefrom, and wherein the recess in the upper face of the rest black is disk-shaped with opposed wings and is complementary in size and shape to said locking means, the wings of the recess being oriented 90° to said wings of said locking means when said intermediate piece is in the proper position.

3. The system of claim 1, wherein said lower face of said plate of said intermediate piece and the upper face of the rest block are respectively provided with a coupling protrusion and cup which are complementary in shape.

4. The system of claim 1, wherein said stud has a tip which is longitudinally split and spread.

* * * * *